US005558684A

United States Patent [19]

DeRosa et al.

[11] Patent Number: 5,558,684

[45] Date of Patent: Sep. 24, 1996

[54] STABILIZED FUEL ADDITIVE COMPOSITION

[75] Inventors: Thomas F. DeRosa, Passaic, N.J.; Joseph M. Russo, Poughkeepsie, N.Y.; Benjamin J. Kaufman, Hopewell Junction, N.Y.; Joseph T. Mastropierro, Cornwall, N.Y.

[73] Assignee: Texaco Inc., White Plains, N.Y.

[21] Appl. No.: 578,296

[22] Filed: Dec. 26, 1995

[51] Int. Cl.[6] ..... C10L 1/22

[52] U.S. Cl. ..... 44/419; 44/423; 44/432; 44/433

[58] Field of Search ..... 44/423, 433, 432

[56] References Cited

U.S. PATENT DOCUMENTS

| | | | |
|---|---|---|---|
| 2,447,615 | 8/1948 | Jones | 252/50 |
| 3,073,822 | 1/1963 | Schultz et al. | 260/247.7 |
| 3,309,182 | 3/1967 | Crowley et al. | 44/433 |
| 3,787,354 | 1/1974 | Cyba | 44/433 |
| 3,960,965 | 6/1976 | Battersby et al. | 44/433 |
| 4,168,242 | 9/1979 | Soula | 44/433 |
| 4,985,047 | 1/1991 | Sung et al. | 44/433 |
| 5,213,585 | 5/1993 | Oppenlaender et al. | 44/433 |
| 5,234,478 | 8/1993 | Su et al. | 44/419 |
| 5,383,942 | 1/1995 | Su et al. | 44/334 |

*Primary Examiner*—Ellen M. McAvoy

*Attorney, Agent, or Firm*—Kenneth R. Priem; James L. Bailey; Richard A. Morgan

[57] ABSTRACT

The invention provides a stabilized fuel additive composition comprising a major portion of the reaction product of a 4-alkyl-2-morpholinone and an alkylphenoxypolyoxyalkylene amine and a minor portion of a stabilizing agent sufficient to prevent the formation of haze in the additive composition comprising a compound selected from polypropyleneoxide diamines of formula $H_2N(CH_2CHCH_3O)_nNH_2$ where n is a number between about 4 and about 25, and triethylene tetramine. A method of stabilizing a fuel additive composition is also provided.

14 Claims, No Drawings

STABILIZED FUEL ADDITIVE COMPOSITION

BACKGROUND OF THE INVENTION

1. Field of the Invention

This invention relates to the field of fuel additives. More specifically, this invention relates to a fuel additive composition which reduces or eliminates haze and sediment during storage or shipment of the additive in bulk form.

2. Description of Related Information

The reaction product of 4-alkyl-2-morpholinone and alkylphenoxypolyoxyalkylene amine has been demonstrated to be an effective intake valve and combustion chamber detergent in spark ignition engines. This additive composition is described in co-assigned U.S. Pats. Nos. 5,234,478 and 5,383,942 which are incorporated herein by reference.

These additives are typically produced at a chemical plant which is remote from the petroleum terminal where the additive is blended with gasoline prior to delivery to gasoline stations. The additive must therefore be shipped from the manufacturing facility to a terminal by tank truck or rail car. Once the additive arrives at the terminal, it is typically stored in a tank from which it is pumped and blended with gasoline stocks. The duration of shipment and storage of additive can last several days to a year, during which time the temperature of the fuel can reach temperatures of 110° F. or higher and moisture may react with the additive to yield haze and sediment. Applicants have observed that during shipment and storage of the additive composition, a flocculent white sediment can form. Since some polyethers are hydrophilic, additive compositions such as these may have a tendency to absorb water from the atmosphere. This is known in the industry as water uptake. The problem is exacerbated under humid conditions. The additive is typically filtered prior to blending with gasoline to prevent any haze or sediment from entering the gasoline supply, because haze and sediment in gasoline are unacceptable for appearance reasons. It is recognized that haze and sediment do not diminish the effectiveness of the additive. However, particulate matter which forms sediment in gasoline can clog filters and fuel injectors, which clogging creates fuel flow problems. Although haze and sediment in the bulk additive can usually be filtered out, filters can become clogged, requiring shut down and replacement.

It is an object of the present invention to provide a chemical means for reducing or eliminating the formation of haziness or sediment during the storage or shipment of the additive composition.

It is a further object of this invention to eliminate or reduce the formation of haziness or sediment during storage or shipment of the additive composition without reducing the additive's intake valve and combustion chamber detergent effectiveness.

SUMMARY OF THE INVENTION

The invention provides a fuel additive composition comprising the reaction product of a 4-alkyl-2-morpholinone and alkylphenoxypolyoxyalkylene amine combined with a stabilizing agent selected from the group consisting of polypropyleneoxide diamines represented by the formula $H_2N(CH_2CHCH_3O)_nNH_2$, wherein is a number between about 4 and about 25 and triethylene tetramine.

A method for stabilizing a fuel additive composition is also provided.

DETAILED DESCRIPTION OF THE INVENTION

The detergent additive composition contemplated by the present invention is the reaction product of a 4-alkyl-2-morpholinone and an alkylphenoxypolyoxyalkylene amine.

The 4-alkyl-2-morpholinone used to prepare the additive of the instant invention can be represented by the formula:

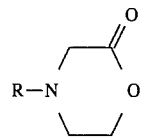

in which R represents a monovalent aliphatic radical having from 1 to about 10 carbon atoms. Preferably, R is an alkyl radical having from 1 to 4 carbon atoms and most preferably having from 1 to 3 carbon atoms. Specific compounds which fall within the scope of this formula include 4-methyl-2-morpholinone, 4-ethyl-2-morpholinone and 4-isopropyl-2-morpholinone. Of these compounds, 4-methyl-2-morpholinone is particularly preferred. These compounds can be made for example as described in U.S. Pat. No. 3,073,822 incorporated herein by reference.

The alkylphenoxypolyoxyalkylene amine reactant can be represented by the formula:

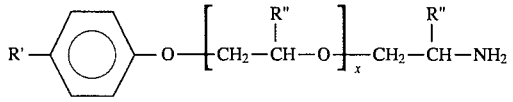

in which R' is a hydrocarbyl radical having from about 4 to about 30 carbon atoms, x represents a number from about 4 to about 50, and R" represents a methyl radical or a mixture of hydrogen and methyl radicals. Preferably, R' represents a monovalent aliphatic radical having from about 6 to about 24 carbon atoms, and more preferably an aliphatic radical having from about 8 to about 20 carbon atoms. In a particularly preferred embodiment, R' is an aliphatic radical having from about 9 to about 18 carbon atoms. Preferably, x is a number from about 6 to about 30, and, most preferably, x is a number from about 10 to about 20.

As indicated above, the alkylphenoxypolyoxyalkylene amine reactant contains an internal radical represented by the formula:

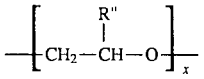

Preferably R" is a methyl group, such that the internal radical is a propylene oxide radical. However, R" can be a mixture of hydrogen and methyl radicals such that the internal radical will comprise a mixture of ethylene oxide and propylene oxide radicals. The mixture of propylene oxide and ethylene oxide radicals can form either a random or block oligomer. When the internal radical represents both propylene oxide and ethylene oxide radicals, the ratio of propylene oxide: ethylene oxide radicals employed may range from about 2:3 to about 999:1. Preferably the range of molar ratios of propylene oxide to ethylene oxide is from about 7:3 to 999:1.

The 4-alkyl-2-morpholinone reactant and the alkylphenoxypolyoxyalkylene amine reactant are typically reacted in about a 1:1 mole ratio. While other mole ratios are contemplated, no significant advantage is realized in departing from about equimolar reaction ratios. The reactants can be reacted at temperatures between room temperature and 130° C., and reaction times will depend upon reaction temperature or kinetics. For example, at 130° C., the reaction will take between 1 and 4 hours, while at 30° C., the reaction will take between 1 and 30 hours. Preferably, the reaction is conducted at about 130° C. for approximately 2 hours.

The additive reaction product of the invention can generally be represented by the formula:

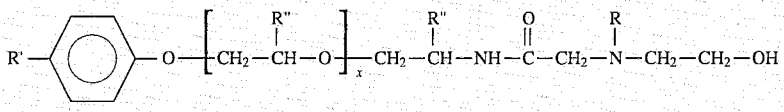

where R, R', R" and x have the same definitions as they do above.

As described above, a flocculent white sediment tends to form during storage of the fuel additive comprising the reaction product of 4-alkyl-2-morpholinone and alkylphenoxypolyoxyalkylene amine, Applicants have discovered that by blending the additive composition with a stabilizing agent, the formation of haziness or sediment is reduced or eliminated.

The stabilizing agents which act to reduce or eliminate the formation of haziness or sediment in the additive composition are selected from polypropylene oxide diamines represented by the formula $H_2N(CH_2CHCH_3O)_nNH_2$ where n is a number between about 4 and about 25, and triethylene tetramine. Preferably, n is a number between about 4 and about 9.

The polypropyleneoxide diamines fuel additives of the invention can be synthesized by any means, and such synthesis forms no part of the invention.

The stabilizing agent can be added to the additive composition in any amount which is effective to reduce or eliminate the formation of haziness or sediment. Typically, the stabilizing agent is added in an amount of about 0.005 wt. % to about 10 wt % based on the weight of the stabilized additive composition, and preferably, in an amount of about 0.05 wt % to about 2.0 wt %, more preferably between about 0.1 wt % and about 1.0 wt %, to provide the stabilized fuel additive of the present invention.

Testing, described below, provided surprising results. Prior to testing the fuel additive stabilizing agents of the invention, Applicants had theorized that the cause of the haziness or sediment formation was a zweitterion resulting from the reaction of reacted or unreacted 4-alkyl-2-morpholinone with water to form a compound of formula

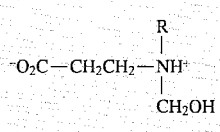

This polar zweitterion would have been expected to have limited solubility in a non-polar medium such as the additive composition contemplated by the invention. Based on this theory, Applicants expected amines and ethylene and polypropylene glycols to react with the zweitterion and solubilize it, thus preventing haziness. However, the ethylene and polypropylene glycols were found to be ineffective, indicating that either a different or an additional mechanism was responsible for the formation of haziness. Surprisingly, only certain amines were effective in eliminating the haziness.

EXAMPLE

The stabilizing additives of the invention were tested for sediment formation in water solution. The additive comprised the reaction product of 4-methyl-2-morpholinone and nonylphenoxypolyoxypropylene amine. Other conventional additives were tested for comparison. The additives were held over a 42 day period at ambient temperature (Table I) and a 135° F. (Table II).

In Tables I and II, PPG refers to polypropylene glycol of indicated molecular weight; THF refers to tetrahydrofuran; Poly THF is polytetrahydrofuran; Sulfonic® N-10, N-60 and N -85 are hydroxyl terminated alkylaromatic polyethers; Jeffamine® D-230 and D-400 refer to diamine terminated polypropylene glycol having molecular weights of approximately 230 and 400 respectively; and TETA refers to triethylene tetraamine.

TABLE I

SOLUTION CLARITY
Visual observation after 42 consecutive days at ambient temperature

| | | | | |
|---|---|---|---|---|
| Additive Concentration (wt. %) | 0.2469 | 0.4946 | 0.7371 | 0.9804 |
| Water Concentration (wt. %) | 0.9876 | 0.9852 | 0.9828 | 0.9804 |
| Ethylene Glycol | Hazy | Hazy | Hazy | Hazy |
| PPG-230 | Hazy | Hazy | Hazy | Hazy |
| PPG-400 | Hazy | Hazy | Hazy | Hazy |
| PPG-1000 | Hazy | Hazy | Hazy | Hazy |
| Poly THF | Hazy | Hazy | Hazy | Hazy |
| Sulfonic ® | | | | |
| N-10 | Hazy | Hazy | Hazy | Hazy |
| N-60 | Hazy | Hazy | Hazy | Hazy |
| N-85 | Hazy | Hazy | Hazy | Hazy |
| Jeffamine ® | | | | |
| D-230 | Clear | Clear | Clear | Clear |
| D-400 | Clear | Clear | Clear | Clear |
| TETA | Clear | Clear | Clear | Clear |
| Methoxy-propyl-amine | Clear | Clear | Clear | Clear |
| Tris(2-amino-ethyl) amine | Clear | Clear | Clear | Clear |

TABLE II

SOLUTION CLARITY
Visual observation after 42 consecutive days at 135° F.

| | | | | |
|---|---|---|---|---|
| Additive Concentration (wt. %) | 0.2469 | 0.4946 | 0.7371 | 0.9804 |
| Water Concentration (wt. %) | 0.9876 | 0.9828 | 0.9828 | 0.9804 |
| Ethylene Glycol | Clear | Hazy | Hazy | Hazy |
| PPG-230 | Hazy | Hazy | Hazy | Hazy |
| PPG-400 | Hazy | Hazy | Hazy | Hazy |
| PPG-1000 | Clear | Clear | Hazy | Hazy |
| Poly THF | Hazy | Hazy | Hazy | Hazy |
| Sulfonic ® | | | | |
| N-10 | Hazy | Hazy | Hazy | Hazy |
| N-60 | Hazy | Hazy | Hazy | Hazy |
| N-85 | Hazy | Hazy | Hazy | Hazy |
| Jeffamine ® | | | | |

TABLE II-continued

| SOLUTION CLARITY Visual observation after 42 consecutive days at 135° F. | | | | |
|---|---|---|---|---|
| D-230 | Clear | Clear | Clear | Clear |
| D-400 | Clear | Clear | Clear | Clear |
| TETA[1] | Clear | Clear | Clear | Clear |
| Methoxy-propylamine | Hazy | Hazy | Hazy | Hazy |
| Tris (2-amino-ethyl) amine | Hazy | Hazy | Hazy | Clear |

[1]Solution clear although a black tarry material appeared on bottom.

The results show that the stabilizing agents of the invention eliminated haziness and in most cases, sediment from the additive composition while the less basic comparative agents did not. This is significant because it suggests that a threshold basicity is needed to prevent the haze which can form in the reaction product of 4-methyl-2-morpholinone and alkylphenoxypolyoxyalkylene amine.

It is evident from the foregoing data that alkyl amines are very effective in preventing haze in the reaction product of 4-methyl-2-morpholinone and alkylphenoxypolyoxyalkylene amine.

While particular embodiments of the invention have been described, it will be understood that the invention is not limited thereto since many modifications may be made, and it is therefore, contemplated to cover by the appended claims any such modifications as fall within the true spirit and scope of the invention.

What is claimed is:

1. A stabilized fuel additive composition comprising a major portion of the reaction product of a 4-alkyl-2-morpholinone and an alkylphenoxypolyoxyalkylene amine and a minor portion of a stabilizing agent sufficient to prevent the formation of haze in the additive composition comprising a compound selected from the group consisting of polypropyleneoxide diamines of formula $H_2N(CH_2CHCH_3O)_nNH_2$ where n is a number between about 4 and about 25, and triethylene tetramine.

2. The stabilized fuel additive composition of claim 1 wherein the stabilizing agent is a polypropyleneoxide diamine of the formula $H_2N(CH_2CHCH_3O)_nNH_2$ where n is a number between about 4 and about 25.

3. The stabilized fuel additive composition of claim 1 wherein the stabilizing agent is a polypropyleneoxide diamine of the formula $H_2N(CH_2CHCH_3O)_nNH_2$ where n is a number between about 4 and about 9.

4. The stabilized fuel additive composition of claim 1 wherein the stabilizing agent is triethylene tetramine.

5. The stabilized fuel additive composition of claim 1 wherein the stabilizing agent comprises about 0.005 wt. % to about 10 wt % of the stabilized fuel additive composition.

6. The stabilized fuel additive composition of claim 1 wherein the stabilizing agent comprises about 0.05 wt % to about 2.0 wt % of the stabilized fuel additive composition.

7. The stabilized fuel additive composition of claim 1 wherein the stabilizing agent comprises about 0.1% and about 1.0 of the stabilized fuel additive composition.

8. A method for stabilizing an additive composition comprising the step of adding a minor amount of a stabilizing agent comprising a compound selected from the group consisting of polypropyleneoxide diamines of the formula $H_2N(CH_2CHCH_3O)_nNH_2$ where n is a number between about 4 and about 25, and triethylene tetramine to a major portion of a fuel additive composition comprising the reaction product of a 4-alkyl-2-morpholinone and an alkylphenoxypolyoxyalkylene amine whereby the haze and sediment are substantially reduced or eliminated.

9. The method of claim 8 wherein the stabilizing agent is a polypropyleneoxide diamine of the formula $H_2N(CH_2CHCH_3O)_nNH_2$ where n is a number between about 4 and about 25.

10. The method of claim 8 wherein the stabilizing agent is a polypropyleneoxide diamine of the formula $H_2N(CH_2CHCH_3O)_nNH_2$ where n is a number between about 4 and about 9.

11. The method of claim 8 wherein the stabilizing agent is triethylene tetramine.

12. The method of claim 8 wherein the stabilizing agent is added to the fuel additive composition such that it comprises about 0.005 wt. % to about 10 wt % of the resulting stabilized fuel additive composition.

13. The method of claim 8 wherein the stabilizing agent is added to the fuel additive composition such that it comprises about 0.05 wt % to about 2.0 wt % of the resulting stabilized fuel additive composition.

14. The method of claim 8 wherein the stabilizing agent is added to the fuel additive composition such that it comprises about 0.1% and about 1.0 of the resulting stabilized fuel additive composition.

* * * * *